US011503394B2

(12) United States Patent
Wen et al.

(10) Patent No.: US 11,503,394 B2
(45) Date of Patent: Nov. 15, 2022

(54) TWS BONE CONDUCTION EARPHONE

(71) Applicant: Transound Electronics Co., Ltd., Dongguan (CN)

(72) Inventors: Tseng-Feng Wen, Dongguan (CN); Huming Zheng, Dongguan (CN)

(73) Assignee: TRANSOUND ELECTRONICS CO., LTD., Dongguan (CN)

( * ) Notice: Subject to any disclaimer, the term of this patent is extended or adjusted under 35 U.S.C. 154(b) by 135 days.

(21) Appl. No.: 17/074,646

(22) Filed: Oct. 20, 2020

(65) Prior Publication Data

US 2021/0352394 A1 Nov. 11, 2021

(30) Foreign Application Priority Data

May 11, 2020 (CN) ..... 202020766230.X
Aug. 28, 2020 (CN) ..... 202010888037.8

(51) Int. Cl.
*H04R 25/00* (2006.01)
*H04R 1/10* (2006.01)

(52) U.S. Cl.
CPC ..... *H04R 1/10* (2013.01); *H04R 2420/07* (2013.01); *H04R 2460/13* (2013.01)

(58) Field of Classification Search
CPC .... H04R 1/105; H04R 1/1066; H04R 1/1091; H04R 2460/13; H04R 25/606; H04R 1/46
See application file for complete search history.

(56) References Cited

U.S. PATENT DOCUMENTS

2009/0185699 A1* 7/2009 Kim ..... H04R 1/1066 381/151

* cited by examiner

*Primary Examiner* — Amir H Etesam
(74) *Attorney, Agent, or Firm* — Leong C. Lei

(57) ABSTRACT

A TWS bone conduction earphone includes an earphone housing and an earphone body. The earphone housing is configured to accommodate the earphone body. The earphone body includes a storage module, a Bluetooth module and a bone conduction module. The storage module is configured to store a Bluetooth address corresponding to a Bluetooth device to be connected and paired. The Bluetooth module is configured to establish a communication with the corresponding Bluetooth device according to the Bluetooth address to obtain an audio signal from the Bluetooth device. The bone conduction module vibrates according to the audio signal for transmitting sounds through ossicles. Using Bluetooth technology, bone conduction wireless answering is realized, without the restriction of the earphone cable. It is more convenient to use, and the sound transmission is realized through bone conduction without damaging hearing.

11 Claims, 10 Drawing Sheets

TWS BONE CONDUCTION EARPHONE

BACKGROUND OF THE INVENTION

1. Field of the Invention

The present invention relates to an earphone, and more particularly to a TWS (true wireless stereo) bone conduction earphone.

2. Description of the Prior Art

Earphones are classified into wired earphones and wireless earphones. The two earphone bodies of the wired earphones communicate with a terminal device through data cables. Since data cables are often entangled, the use of wired earphones is inconvenient. A wireless earphone communicates with the terminal device through wireless technology, such as Bluetooth. TWS (True Wireless Stereo) earphones are one of wireless earphones. TWS bone conduction earphones are mainly composed of a first wireless earphone and a second wireless earphone. Technically, TWS bone conduction earphone means that the terminal device communicates with the first wireless earphone through Bluetooth, and the first wireless earphone communicates with the second wireless earphone through the Bluetooth communication protocol, thereby realizing the true wireless separation and use of the left and right channels of Bluetooth.

Most of the existing TWS earphones use air conduction. The specific principle is that sound brings air vibration, enabling the user to hear the sound. Then, the vibration is transmitted to the eardrum through the external acoustic meatus and then to the internal ear nerve through the eardrum. Obviously, wearing such earphones for a long time will cause ear discomfort and a certain degree of damage to hearing.

SUMMARY OF THE INVENTION

In view of the shortcomings of the prior art, the primary object of the present invention is to provide a TWS (true wireless stereo) bone conduction earphone to avoid hearing loss.

In an embodiment of the present invention, a TWS (True Wireless Stereo) bone conduction earphone is provided. The TWS bone conduction earphone comprises an earphone housing and an earphone body. The earphone housing is configured to accommodate the earphone body. The earphone body includes a storage module, a Bluetooth module and a bone conduction module. The storage module is configured to store a Bluetooth address corresponding to a Bluetooth device to be connected and paired. The Bluetooth module is configured to establish a communication with the corresponding Bluetooth device according to the Bluetooth address to obtain an audio signal from the Bluetooth device. The bone conduction module vibrates according to the audio signal for transmitting sounds through ossicles.

In one of the possible implementations, the earphone housing includes a first housing and a second housing; the first housing and the second housing are engaged with each other to form a main receiving chamber for receiving the earphone body.

In one of the possible implementations, the first housing includes a first connecting portion and a first housing portion; the first housing portion is arranged at one side of the first connecting portion; the second housing includes a second connecting portion and a second housing portion; the second connecting portion is engaged with the first connecting portion to form a first receiving chamber; the second housing portion is arranged at one side of the second connecting portion, a touch area is provided on an outer side wall of the second housing portion, so as to control the TWS bone conduction earphone by operating the touch area; the second housing portion is engaged with the first housing portion to form a second receiving chamber, wherein the first receiving chamber and the second receiving chamber are configured to receive the earphone body.

In one of the possible implementations, the earphone housing further includes an ear hook. The ear hook is a curved ear hook to be located behind a pinna of a user's ear. The ear hook includes a first connecting end and a free end. The first connecting end is connected to the second connecting portion. The free end is opposite to the first connecting end. The free end is arc-shaped. When the user wears the TWS bone conduction earphone, the free end of the ear hook is located above a back side of the user's ear.

In one of the possible implementations, the ear hook is detachably connected to the second connecting portion.

In one of the possible implementations, the second connecting portion is provided with an engaging portion, the first connecting end of the ear hook is provided with a receiving cavity, and the engaging portion is detachably connected to the receiving cavity.

In one of the possible implementations, the TWS bone conduction earphone further comprises an ear hook. The ear hook is a head-mounted ear hook. The TWS bone conduction earphone includes two TWS bone conduction earphones. Two ends of the head-mounted ear hook are connected to the earphone housings of the two TWS bone conduction earphones, respectively.

In one of the possible implementations, the bone conduction module includes a power amplifier and a bone conduction vibrator; the power amplifier is electrically connected to the bone conduction vibrator and the Bluetooth module, and is configured to process and transmit the audio signal received by the Bluetooth module to the bone conduction vibrator; the bone conduction vibrator is configured to vibrate the ossicles according to the processed audio signal to transmit sounds; the power amplifier is arranged in the first receiving chamber; the bone conduction vibrator is arranged in the second receiving chamber.

In one of the possible implementations, the earphone body further includes a charging and discharging module and a battery; the charging and discharging module is electrically connected to the battery for controlling charging and discharging of the battery; the battery is configured to supply power to the TWS bone conduction earphone; the charging and discharging module is arranged in the first receiving chamber; the battery is arranged in the second receiving chamber.

In one of the possible implementations, two sides of the first housing portion are formed with a first accommodating groove and a second accommodating groove, respectively. The first accommodating groove communicates with the second accommodating groove. The first accommodating groove is configured to accommodate the bone conduction vibrator. The second accommodating groove is configured to accommodate the battery.

In one of the possible implementations, a gap between the bone conduction vibrator and the battery is 0.2 mm to 3 mm.

In one of the possible implementations, the TWS bone conduction earphone further comprises an earplug made of silicone. The earplug is arranged on one side of the earphone housing and covers the bone conduction vibrator. One side of the earplug, facing the ear, is provided with a positioning protrusion. The positioning protrusion protrudes obliquely outward from an outer peripheral side of the earplug.

In one of the possible implementations, a part of the bone conduction vibrator is arranged in the first accommodating groove, and another part of the bone conduction vibrator is exposed from the first accommodating groove. The earplug covers the another part of the bone conduction vibrator exposed from the first accommodating groove.

The embodiment of the present invention provides a TWS bone conduction earphone, comprising an earphone housing and an earphone body. The earphone housing is configured to accommodate the earphone body. The earphone body includes a storage module, a Bluetooth module and a bone conduction module. The storage module is configured to store a Bluetooth address corresponding to a Bluetooth device to be connected and paired. The Bluetooth module is configured to establish a communication with the corresponding Bluetooth device according to the Bluetooth address to obtain an audio signal from the Bluetooth device. The bone conduction module vibrates according to the audio signal for transmitting sounds through ossicles. Using Bluetooth technology, bone conduction wireless answering is realized, without the restriction of the earphone cable. It is more convenient to use, and the sound transmission is realized through bone conduction without damaging hearing.

DETAILED DESCRIPTION OF THE PREFERRED EMBODIMENTS

Embodiments of the present invention will now be described, by way of example only, with reference to the accompanying drawings. The described embodiments are part of the embodiments of the invention, rather than all of the embodiments.

Based on the embodiments in the invention, all other embodiments obtained by those of ordinary skill in the art without creative labor are within the protection scope of the invention.

FIGS. 1 to 9 show the specific structure of a TWS bone conduction earphone 1 according to an embodiment of the present invention.

Figure 1:
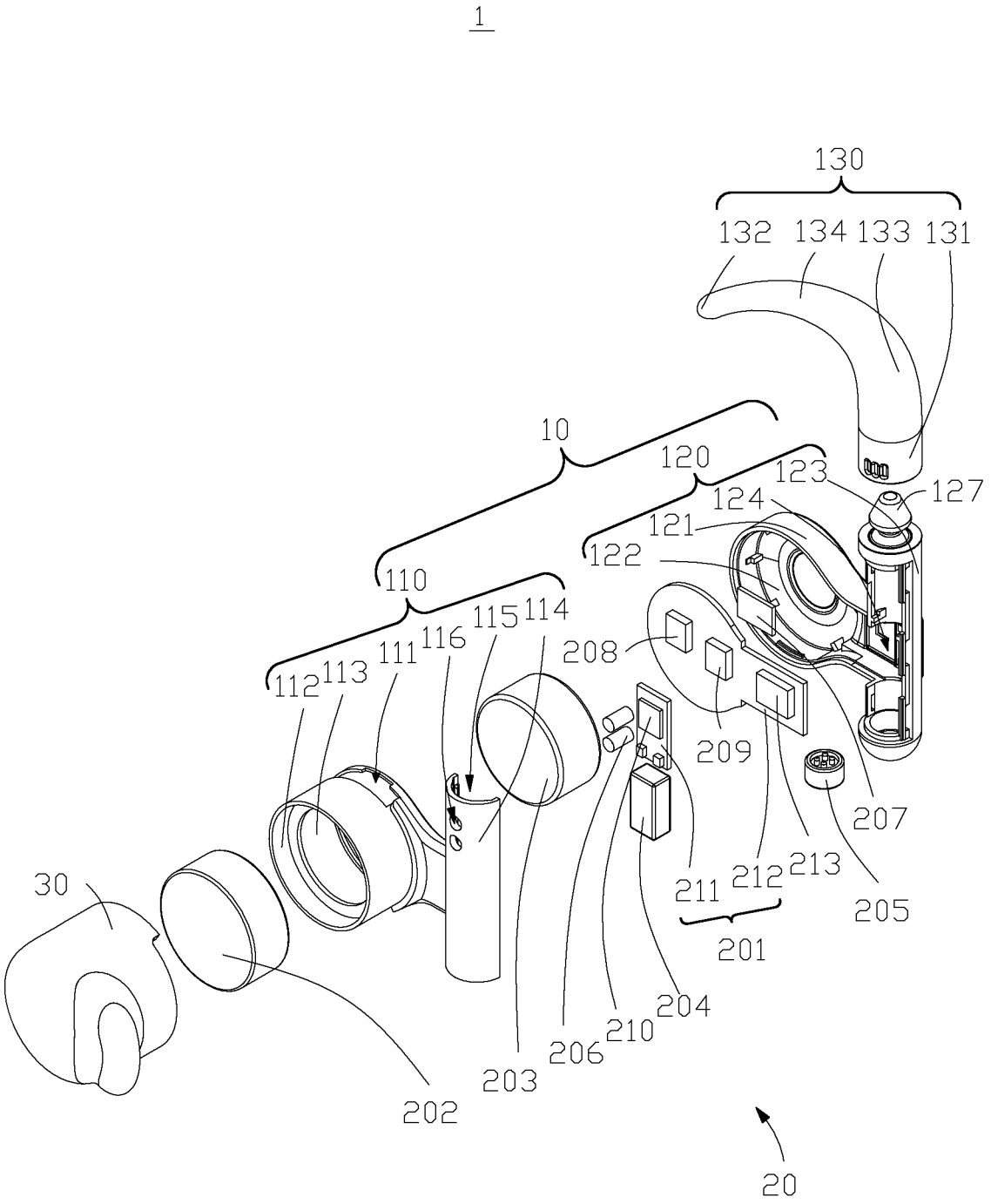
FIG. 1 is an exploded view of the TWS bone conduction earphone according to the present invention.

As shown in FIG. 1, the TWS bone conduction earphone 1 includes an earphone housing 10, an earphone body 20, and an earplug 30.

In the embodiment of the present invention, the earphone housing 10 includes a first housing 110 and a second housing 120. The first housing 110 and the second housing 120 are engaged with each other to form a main receiving chamber (not shown) for accommodating the earphone body 20. In one of the possible implementations, the earphone housing 10 may be made of silicone.

In the embodiment of the present invention, the first housing 110 includes a first housing portion 111. The first housing portion 111 is substantially in the form of a pipe. Specifically, two sides of the first housing portion 111 are formed with a first accommodating groove 112 and an adjacent second accommodating groove 113, respectively. The second accommodating groove 113 and the first accommodating groove 112 each have an opening at one end thereof The first accommodating groove 112 communicates with the second accommodating groove 113 for accommodating corresponding components. The second accommodating groove 113 and the first accommodating groove 112 are substantially circular.

In one of the possible implementations, the size of the opening of the first accommodating groove 112 may be different from that of the second accommodating groove 113, which is determined according to the accommodated components and is not specifically limited in the invention.

In one of the possible implementations, the first housing 110 further includes a first connecting portion 114. The first housing portion 111 is arranged at a middle position of one side of the first connecting portion 114. In one of the possible implementations, the first housing portion 111 is integrally formed with the first connecting portion 114. The first connecting portion 114 is substantially arc-shaped with a lateral opening. One side of the first connecting portion 114 is recessed to form a first receiving groove 115. The first receiving groove 115 is arc-shaped. The first receiving groove 115 is in communication with the opening of the first connecting portion 114. The first receiving groove 115 is in communication with the second accommodating groove 113 for accommodating corresponding components. One side of the first connecting portion 114 is formed with a charging hole 116.

In the embodiment of the present invention, the first accommodating groove is configured to accommodate a bone conduction vibrator, and the second accommodating groove is configured to accommodate a battery. By arranging two accommodating grooves on the first housing portion 111, one accommodating groove for the bone conduction vibrator 202 and the other accommodating groove for the battery 203, the earphone housing 10 has a large enough space. The battery 203 can be placed more, and the battery 203 has more capacity.

In the embodiment of the present invention, the second housing 120 includes a second housing portion 121. The second housing portion 121 is substantially in a round shape with an opening at one end thereof One side of the second housing portion 121 is formed with a third accommodating groove 122. The third accommodating groove 122 is substantially circular. The third accommodating groove 122 communicates with the opening of the second housing portion 121 for accommodating corresponding components.

In one of the possible implementations, the second housing 120 further includes a second connecting portion 123. The second housing portion 121 is arranged at a middle position of one side of the second connecting portion 123. In one of the possible implementations, the second housing portion 121 is integrally formed with the second connecting portion 123. The second connecting portion 123 is substantially in the form of a hollow cylinder to form a second receiving groove 124. One side of the second connecting portion 123 is formed with a strip-shaped opening to expose the corresponding second receiving groove 124. The second receiving groove 124 is in communication with the opening of the second connecting portion 123. The second receiving groove 124 is in communication with the third accommodating groove 122 for accommodating corresponding components. One end (i.e., the bottom) of the first connecting portion 114 is formed with a microphone port (not shown). The microphone port is provided with a waterproof membrane. The waterproof membrane can effectively improve the waterproof performance and prevent water from directly entering the second receiving groove 124 via the microphone port.

Figure 2:
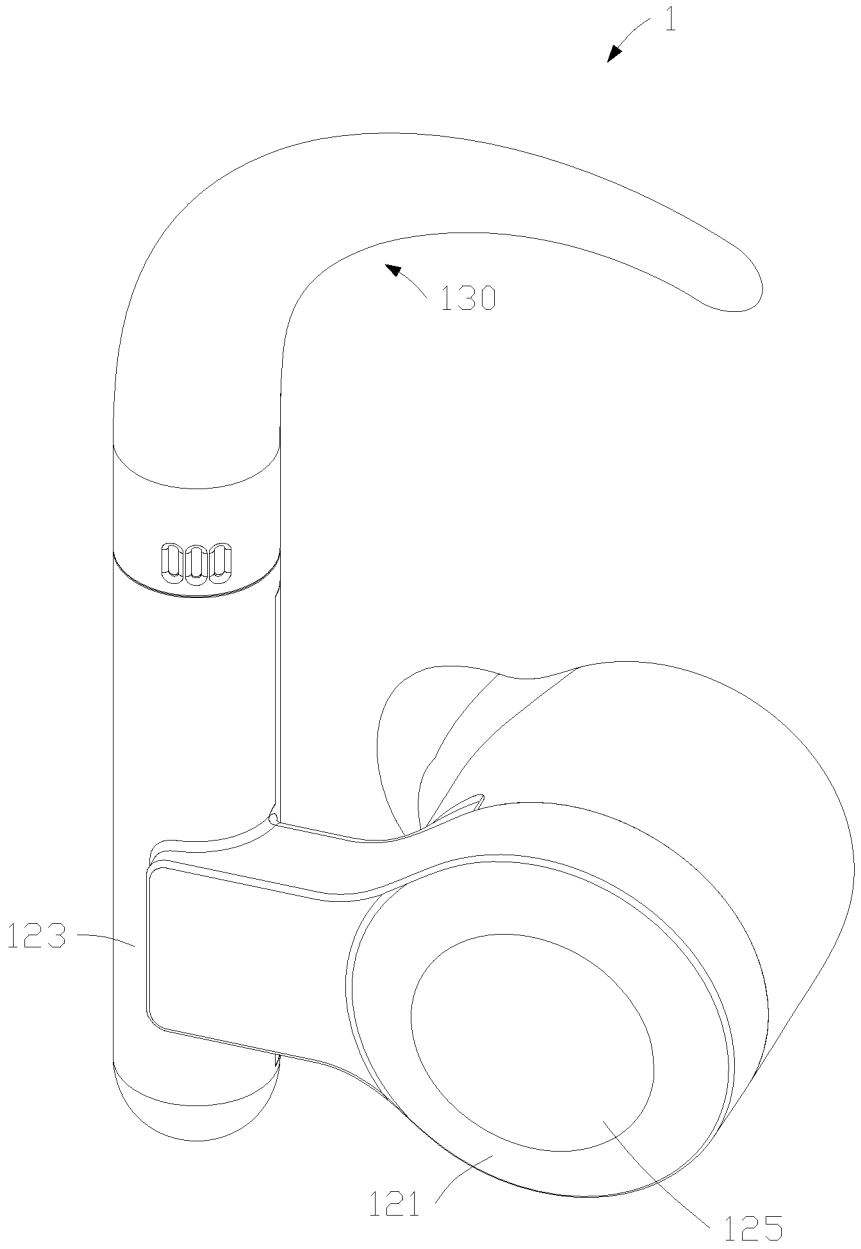
FIG. 2 is a perspective view of the TWS bone conduction earphone shown in FIG. 1.

In one of the possible implementations, referring to FIG. 2, the outer side wall of the second housing portion 121 has a touch area 125. The touch area 125 is electrically connected to the earphone body 20. The user controls the earphone by operating the touch area 125.

Figure 3:
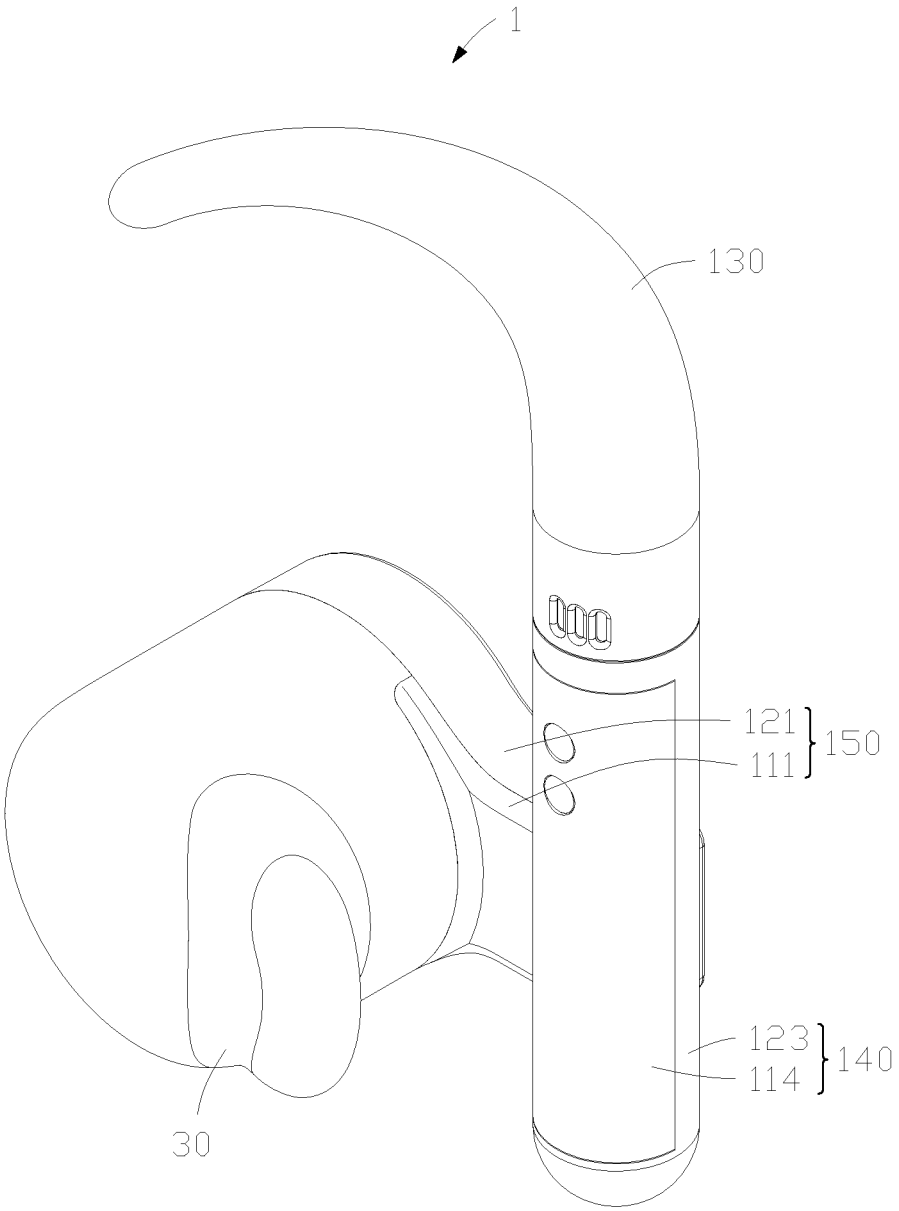
FIG. 3 is a schematic view of the TWS bone conduction earphone shown in FIG. 2 viewed from another angle.

Referring to FIG. 3, the first housing 110 and the second housing 120 are engaged with each other to form a main connecting portion 140 and a main housing portion 150. The main housing portion 150 is disposed at a middle position of one side of the main connecting portion 140 and is substantially perpendicular to the main connecting portion 140. One end (i.e., the bottom) of the main connecting portion 140 is formed with the microphone port.

Specifically, as shown in FIG. 1, the first connecting portion 114 and the second connecting portion 123 are engaged with each other to form the main connecting portion 140. The main connecting portion 140 is cylindrical. When the first connecting portion 114 is engaged with the second connecting portion 123, the first receiving groove 115 and the second receiving groove 124 together form a first receiving chamber. The first housing portion 111 and the second housing portion 121 are engaged with each other to form the main housing portion 150. The main housing portion 150 is substantially in a round shape. When the first housing portion 111 is engaged with the second housing portion 121, the second accommodating groove 113 communicates with third accommodating groove 122. The second accommodating groove 113 is disposed between the first accommodating groove 112 and the third accommodating groove 122. The first accommodating groove 112, the second accommodating groove 113 and the third accommodating groove 122 communicate with each other to form a second receiving chamber. The first receiving chamber and the second receiving chamber communicate with each other to form the main receiving chamber.

In the embodiment of the present invention, the first housing portion 111 and the second housing portion 121 are detachably connected. The first connecting portion 114 and the second connecting portion 123 are detachably connected.

In one of the possible implementations, a glue layer is provided at the join of the first housing portion 111 and the second housing portion 121 to fix the first housing portion 111 and the second housing portion 121. In addition, in other embodiments, a waterproof rubber pad may be provided at the join of the first housing portion 111 and the second housing portion 121. Firstly, the waterproof rubber pad is arranged between the first housing portion 111 and the second housing portion 121, and then glue is used to fix the first housing portion 111 and the second housing portion 121, thereby achieving fixing and waterproof effects.

Similarly, a glue layer is provided at the join of the first connecting portion 114 and the second connecting portion 123 to fix the first connecting portion 114 and the second connecting portion 123. In addition, in other embodiments, a waterproof rubber pad may be provided at the join of the first connecting portion 114 and the second connecting portion 123. Firstly, the waterproof rubber pad is arranged between the first connecting portion 114 and the second connecting portion 123, and then glue is used to fix the first connecting portion 114 and the second connecting portion 123, thereby achieving fixing and waterproof effects.

In the embodiment of the present invention, as shown in FIG. 1, an ear hook 130 is connected to the main connecting portion 140.

In the embodiment of the present invention, the ear hook 130 is a curved ear hook to be located behind the pinna of a user's ear. The ear hook 130 includes a first connecting end 131 and a free end 132. The first connecting end 131 is connected to the second connecting portion 123 of the earphone housing 10. The free end 132 is one end of the ear hook 130 opposite the first connecting end 131. The free end 132 is arc-shaped. When the user uses the ear hook 130, the ear hook 130 is hooked on the ear. The ear hook 130 is in contact with the ear. The free end 132 is suspended. The free end 132 is close to the pinna of the ear, and is located above the back of the ear. For example, the free end 132 is located above the tragus.

Specifically, the ear hook 130 includes a main body portion 133 and an extension portion 134. One end of the main body portion 133 is connected to the first connecting end 131, and the first connecting end 131 is connected to the earphone housing 10. The other end of the main body portion 133 is connected to the extension portion 134. The main body portion 133 extends in a vertical direction. That is, when the main body portion 133 extends in the vertical direction, it gradually extends obliquely to one side, so that the other end of the main body portion 133 gradually extends obliquely upward to the root of the pinna. The extension portion 134 extends obliquely downward along the outer surface of the main body portion 133. That is, when the extension portion 134 extends along the extension direction of the main body portion 133, it extends downward in the direction close to the ear. After the other end of the main body portion 133 extends to the root of the pinna, the extension portion 134 extends downward from the other end of the main body portion 133 so that the ear hook 130 can be hooked to the ear. When the ear hook 130 is worn, based on the shape of the main body portion 133 and the extension portion 134, the ear hook 130 can be hung on the ear. Moreover, the free end 132 is located above the first connecting end 131, that is, the extension arc of the ear hook 130 is relatively short.

In the embodiment of the present invention, the width of the ear hook 130 gradually decreases from the main body portion 133 to the extension portion 134. In one of the possible implementations, the ear hook 130 is cylindrical as a whole, and the radius of the ear hook 130 gradually decreases from the first connecting end 131, the main body portion 133 and the extension portion 134 to the free end 132 in order.

It should be noted that the ear hook 130 may be made of silicone. In other embodiments, a titanium wire may be arranged in the ear hook 130 to be bent into a fixed form through the titanium wire.

Figure 4:
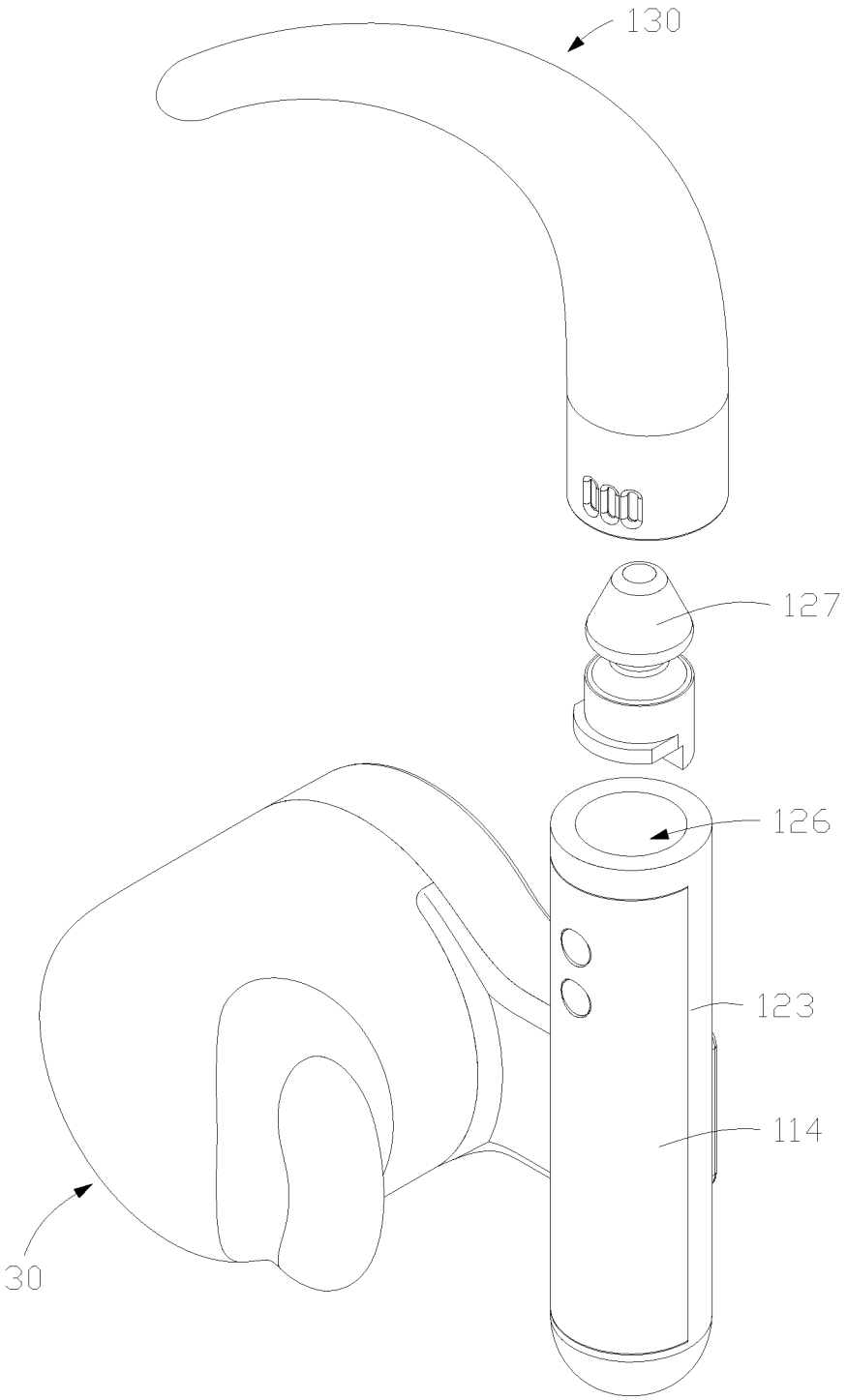
FIG. 4 is a partial exploded view of the TWS bone conduction earphone shown in FIG. 3.
Figure 5:
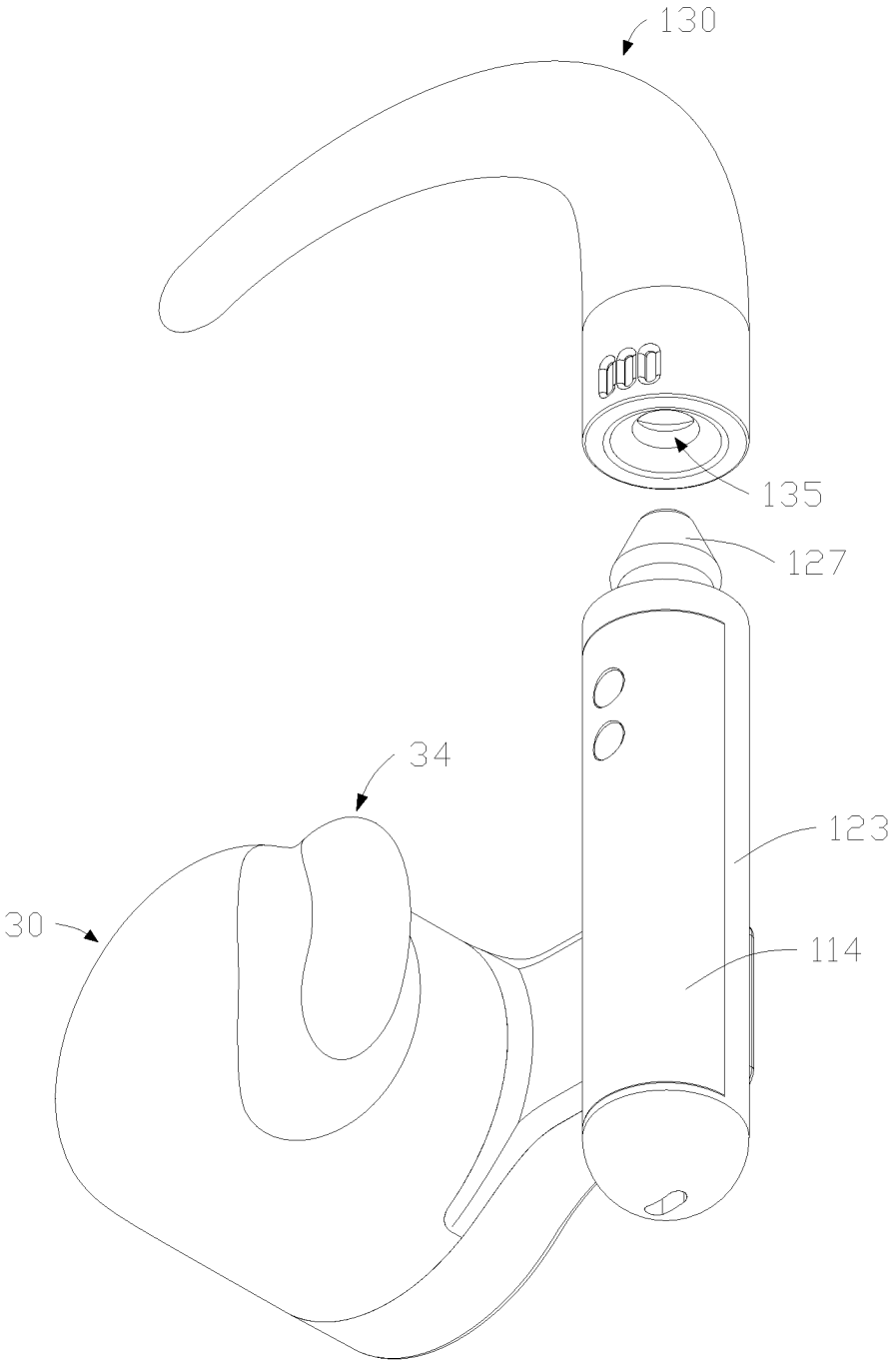
FIG. 5 is a schematic view of the TWS bone conduction earphone shown in FIG. 4 viewed from another angle.

In one of the possible implementations, referring to FIG. 4 and FIG. 5, the second connecting portion 123 is provided with an accommodating hole 126 and an engaging portion 127. The first connecting end 131 is provided with a receiving cavity 135 corresponding to the engaging portion 127. The engaging portion 127 is detachably connected to the receiving cavity 135. Specifically, the top of the second connecting portion 123 is formed with the accommodating hole 126. One end of the engaging portion 127 is inserted into the accommodating hole 126. When one end of the engaging portion 127 is inserted into the accommodating hole 126, the other end of the engaging portion 127 extends out of the accommodating hole 126 to be inserted into the receiving cavity 135.

It should be noted that the detachable connection of the ear hook 130 and the earphone housing 10 includes a plug-in connection, threaded connection, snap connection, contact connection, etc., but not limited thereto. It only needs to satisfy that the ear hook 130 and the main connecting portion 140 are detachably connected, which is not specifically limited in the invention.

In one of the possible implementations, the ear hook 130 is fixedly connected to the main connecting portion 140. The ear hook 130 is integrally formed with the main connecting portion 140.

In the embodiment of the present invention, the specific structure and type of the ear hook 130 are not limited. For example, the ear hook 130 may be an ear hook structure, a neck hook structure, or a head-mounted bone conduction earphone.

Figure 6:
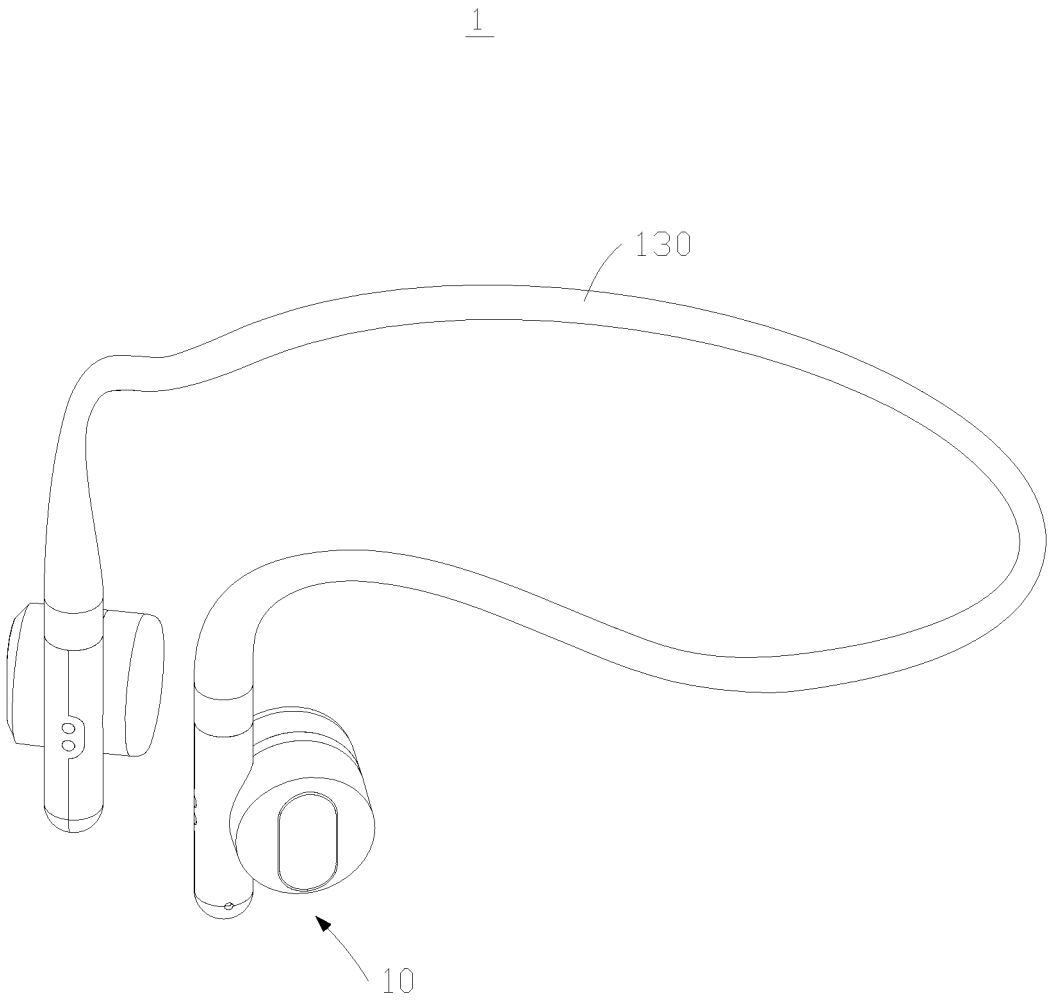
FIG. 6 is a schematic view of another ear hook according to the present invention.

Exemplarily, referring to FIG. 6, the ear hook 130 may be implemented as a head-mounted ear hook. The difference between the head-mounted ear hook and the hook-type ear hook shown in FIG. 1 is that the extension arc of the head-mounted ear hook is longer than the extension length of the hook-type ear hook, and the ear hooks of the two earphones are connected together. That is, two ends of the head-mounted ear hook are connected to the earphone housings 10 of the two earphones, respectively. The head-mounted ear hook can reduce the burden on the weight of the ears to provide comfort when the user wears the earphone.

It should be noted that when the ear hook 130 is a head-mounted ear hook, the TWS bone conduction earphone 1 may not include the earplug 30. The bone conduction vibrator 202 is directly placed close to the ear ossicles for vibration and sound transmission. Alternatively, the TWS bone conduction earphone 1 may include a protective cover (not shown). The protective cover is sleeved on the bone conduction vibrator 202 to protect the bone conduction vibrator 202. The bone conduction vibrator 202 and the protective cover are placed on the area of the ear ossicles. The vibration and sound of the bone conduction vibrator 202 are transmitted through the protective cover. Alternatively, the TWS bone conduction earphone 1 further includes an earplug 30. The earplug 30 is sleeved on the bone conduction vibrator 202. When the head-mounted ear hook is worn, the bone conduction vibrator 202 and the earplug 30 are inserted into the ear together.

In one of the possible implementations, when the ear hook 130 is not in use, a cap (not shown) is provided on the accommodating hole 126 on the second connecting portion 123 for covering the accommodating hole 126, thereby providing a waterproof and dustproof effect.

In the embodiment of the present invention, as shown in FIG. 1, the earphone body 20 is accommodated in the earphone housing 10.

The earphone body 20 includes a circuit board 201, a bone conduction vibrator 202, a battery 203, a magnetic member 204, a microphone 205, a charging contact 206, a touch switch 207, a storage module 208, a Bluetooth module 209, a charging and discharging module 210, and a power amplifier 213, and a signal light (not shown). The bone conduction vibrator 202, the battery 203, the microphone 205, the charging contact 206, the touch switch 207, the storage module 208, the Bluetooth module 209, the charging and discharging module 210, the power amplifier 213 and the signal light are all electrically connected to the circuit board 201.

In the embodiment of the present invention, the circuit board 201 includes a first printed circuit board 211 and a second printed circuit board 212. The first printed circuit board 211 is electrically connected to the second printed circuit board 212. The first printed circuit board 211 is in the form of a straight strip. The first printed circuit board 211 is disposed in the first receiving chamber. The second printed circuit board 212 is disposed in the second chamber. Specifically, the second printed circuit board 212 is disposed in the third accommodating groove 122. The second printed circuit board 212 corresponds in shape to the third accommodating groove 122.

In the embodiment of the present invention, when the space between the first housing portion 111 and the second housing portion 121 is sufficient, the TWS bone conduction earphone 1 may be provided with only one printed circuit board. All the circuit parts are disposed on one printed circuit board. Alternatively, the first printed circuit board 211 is not necessarily arranged in the first receiving chamber, but may be directly arranged in the second receiving chamber, and may be set according to actual production requirements, which is not specifically limited in the invention.

In the embodiment of the present invention, the storage module 208 is arranged on the second printed circuit board 212. The storage module 208 may include a high-speed random access memory, and may also include a non-volatile memory, such as a hard disk, a memory, a plug-in hard disk, a smart memory card (SMC), a secure digital (SD) card, a flash card, at least one magnetic disk storage, flash memory device, or other solid-state volatile storage devices.

In the embodiment of the present invention, the storage module 208 stores a Bluetooth address. The Bluetooth address is the Bluetooth address corresponding to the Bluetooth device to be paired and connected. The Bluetooth address may be plural. The Bluetooth address may be a Bluetooth address corresponding to the Bluetooth device to be connected and paired stored in advance by the user. The Bluetooth address may be the stored Bluetooth address after obtaining the address of the Bluetooth device by searching for nearby Bluetooth devices during use. The TWS bone conduction earphone 1 may be in communication with different Bluetooth devices according to the multiple Bluetooth addresses pre-stored in the storage module 208. The Bluetooth device may be an electronic device with Bluetooth function, such as a mobile phone, earphone, computer or tablet. Exemplarily, the Bluetooth address includes a first Bluetooth address and a second Bluetooth address. The first Bluetooth address is used for a Bluetooth connection with a first Bluetooth device. The second Bluetooth address is used for a Bluetooth connection with a second Bluetooth device. In this embodiment, the type of Bluetooth device is not limited. For example, the first Bluetooth device and the second Bluetooth device may be different products or products of the same type. For example, the first Bluetooth device is a mobile phone, and the second Bluetooth device is an earphone. In the embodiment of the present invention, The Bluetooth module 209 is arranged on the second printed circuit board 212. The Bluetooth module 209 includes a Bluetooth chip, and may also include a unit or device with a Bluetooth function and a control function.

In the embodiment of the present invention, the Bluetooth module 209 is electrically connected to the storage module 208. The Bluetooth module 209 retrieves the Bluetooth address in the storage module 208 to perform a Bluetooth connection with an external Bluetooth device according to the retrieved Bluetooth address. Exemplarily, taking an earphone of the TWS bone conduction earphone as an example, after the earphone establishes a Bluetooth connection with the mobile phone, it receives the audio signal transmitted by the mobile phone via Bluetooth. The earphone establishes a Bluetooth connection with the other earphone, and the other earphone receives the audio signal transmitted by the earphone via Bluetooth.

In the embodiment of the present invention, the second printed circuit board 212 may further include a power amplifier 213 and wires (not shown). The power amplifier 213 is electrically connected to the bone conduction vibrator 202 through a wire. The power amplifier 213 is electrically connected to the Bluetooth module 209. After receiving the audio signal of the Bluetooth module 209, the power amplifier 213 processes the audio signal and transmits it to the bone conduction vibrator 202. The bone conduction vibrator 202 vibrates and transmits sound after receiving the processed audio signal.

In one of the possible implementations, the power amplifier is used to amplify the power of the signal output by the Bluetooth module 209 and output the amplified signal to the bone conduction vibrator 202. Through the power amplifier, the output power is increased, the sound signal is amplified, and the listening effect is improved.

It should be noted that the power amplifier may be an independent circuit or chip, or the power amplifier may be integrated with a processor, that is, a corresponding processor is provided to realize the corresponding power amplification function, which is not specifically limited in the invention.

In the embodiment of the present invention, the bone conduction vibrator 202 is in a circular shape. Apart of the bone conduction vibrator 202 is disposed in the first accommodating groove 112, and the other part of the bone conduction vibrator 202 is exposed from one end of the first accommodating groove 112. The bone conduction vibrator 202 is electrically connected to the second printed circuit board 212. The bone conduction vibrator 202 converts the audio signal received from the second printed circuit board 212 into mechanical vibrations of different frequencies. The bone conduction vibrator 202 exposed from the first accommodating groove 112 transmits vibration through the ossicles in contact with the ear.

In the embodiment of the present invention, the battery 203 is disposed in the second accommodating groove 113 and the third accommodating groove 122. The gap between the bone conduction vibrator 202 and the battery 203 is 0.2 mm to 3 mm. In one of the possible implementations, the gap between the bone conduction vibrator 202 and the battery 203 is 0.2 mm to 1 mm. In one of the possible implementations, the gap between the bone conduction vibrator 202 and the battery 203 is 0.5 mm to 1 mm. In one of the possible implementations, the gap between the bone conduction vibrator 202 and the battery 203 is 1 mm to 3 mm. The invention does not specifically limit this.

By setting the gap between the bone conduction vibrator 202 and the battery 203, it is possible to ensure that the bone conduction vibrator 202 has enough space, so that the swing amplitude of the bone conduction vibrator 202 is large, and the overall space of the TWS bone conduction earphone 1 is small. The battery 203 is electrically connected to the charging and discharging module 210 on the first printed circuit board 211. The charging contact 206 is electrically connected to the charging and discharging module 210 on the first printed circuit board 211.

In the embodiment of the present invention, the charging and discharging module 210 is arranged on the first printed circuit board 211. The charging and discharging module 210 may be a charging and discharging circuit. The charging and discharging circuit is used to control the charging and discharging of the battery 203.

In one of the possible implementations, one end of the charging contact 206 is electrically connected to the first printed circuit board 211 through an elastic sheet, and the other end of the charging contact 206 passes through the charging hole 116 to be exposed from the charging hole 116 for being in contact with and electrically connected to an external power source to charge the charging and discharging module on the first printed circuit board. For example, when the TWS bone conduction earphone 1 is attached to a charging box (not shown), the charging contact 206 is electrically connected to an external power source in the charging box. The external power source transmits electric energy to the charging and discharging module through the charging contact 206, and then the charging and discharging module 210 charges the battery 203.

In one of the possible implementations, a glue layer is provided at the join of the charging contact 206 and the first connecting portion 114 to fix the charging contact 206 and the first connecting portion 114. In addition, in other embodiments, a waterproof rubber pad may be provided at the join of the charging contact 206 and the first connecting portion 114. Firstly, the waterproof rubber pad is arranged between the charging contact 206 and the first connecting portion 114, and then glue is used to fix the charging contact 206 and the first connecting portion 114, thereby achieving fixing and waterproof effects.

In the embodiment of the present invention, the magnetic member 204 is a magnet arranged in the first receiving chamber. The magnetic member 204 is attached to a charging box (not shown) when the TWS bone conduction earphone 1 is charged, so as to charge the TWS bone conduction earphone 1 through the charging box.

In the embodiment of the present invention, the microphone 205 is arranged in the first receiving chamber and arranged corresponding to the microphone hole. The microphone 205 is electrically connected to the circuit board 201 for converting audio signals into electrical signals. When the TWS bone conduction earphone is hung on the ear via the ear hook 130, the microphone hole is located at the lower end of the earphone and close to the mouth. The microphone 205 collects the user's speaking voice and converts it into electrical signals. The microphone 205 may be a moving coil microphone, a condenser microphone, an electret condenser microphone and a silicon condenser micromachined microphone, but not limited thereto.

In the embodiment of the present invention, the signal light is arranged on the outer side wall of the second housing portion 121. The signal light is configured to warn a state of the TWS bone conduction earphone 1, such as a communication connection state, a charging state, and the like. For example, the signal light is electrically connected to the first printed circuit board 211 to obtain the charging state of the battery 203. When the battery 203 is fully charged, the signal light is used to warn the user. When the power of the battery 203 is too low, the signal light is used to warn the user. The signal light may be set with different colors for warning the user of different states.

In the embodiment of the present invention, the touch switch 207 is configured to control the TWS bone conduction earphone 1 for turning on/off the earphone, adjusting the volume, or answering the phone, etc. In one of the possible implementations, the touch switch 207 is disposed between the battery 203 and the second housing portion 121 and is electrically connected to the second printed circuit board 212. The touch switch 207 may be a copper foil sheet. The copper foil sheet is set corresponding to the touch area 125 to sense the user's operation on the touch area 125, so as to realize the control of the TWS bone conduction earphone 1, such as turning on/off the TWS bone conduction earphone 1 and activating the Bluetooth module 209. Exemplarily, the user touches the touch area 125 to control the earphone body 20 of the TWS bone conduction earphone 1, for example, activating the Bluetooth module 209 of the earphone body 20.

Figure 7:
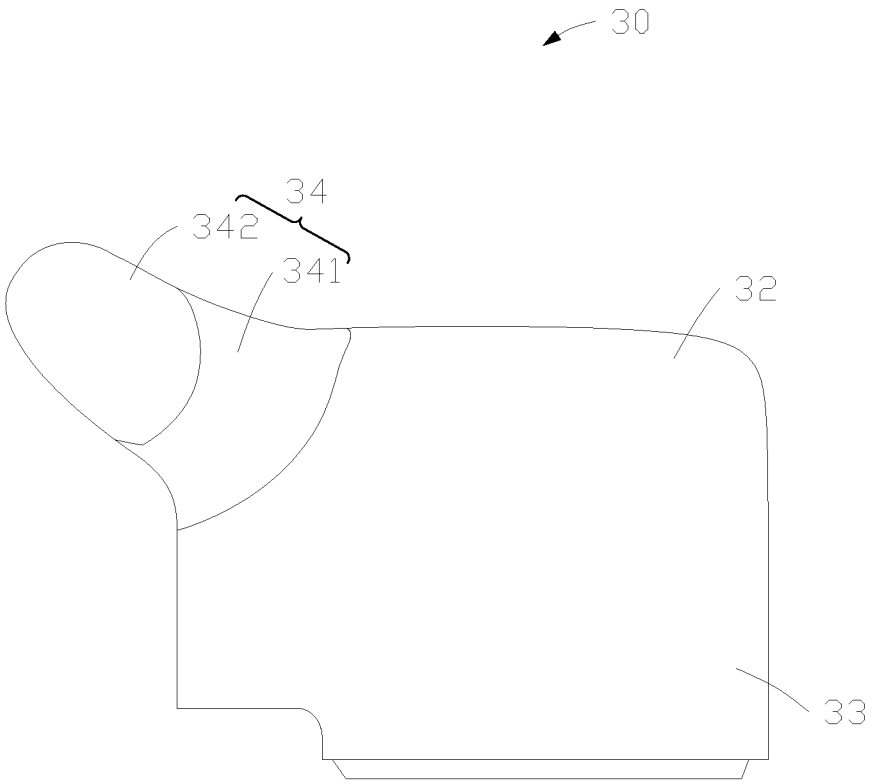
FIG. 7 is a schematic view of a preferred embodiment of the earplug shown in FIG. 1 according to the present invention.
Figure 8:
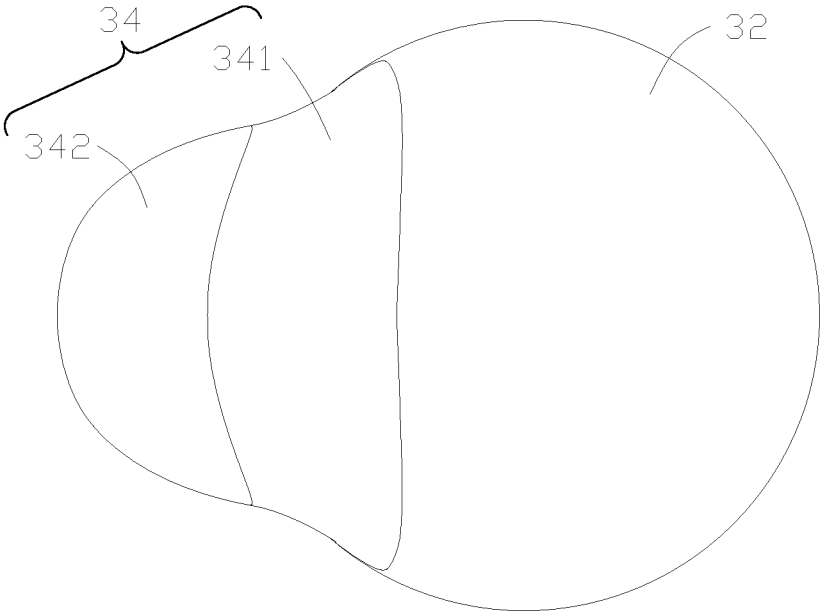
FIG. 8 is a schematic view of the earplug shown in FIG. 7 viewed from another angle.
Figure 9:
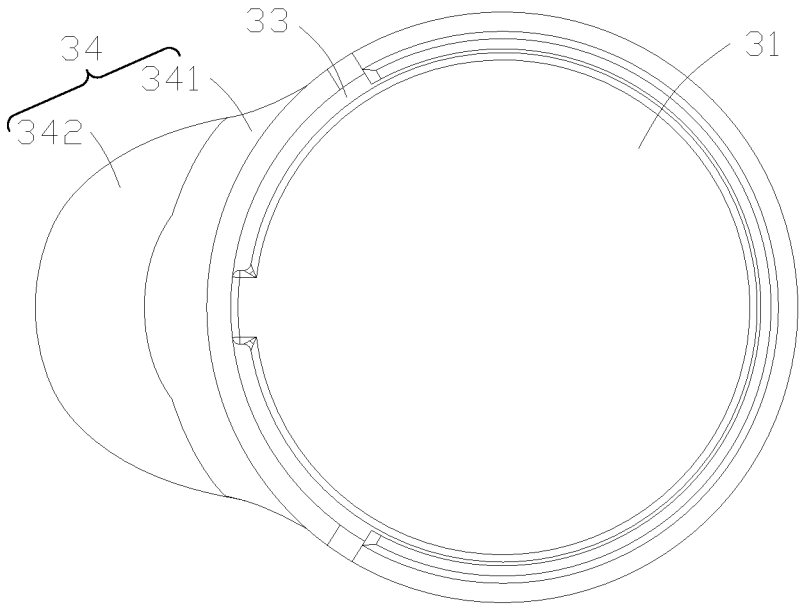
FIG. 9 is a schematic view of the earplug shown in FIG. 7 viewed from another angle.

Referring to FIGS. 7 to 9, the earplug 30 is disposed on one side of the second housing portion 121. One side of the earplug 30 is recessed to form a recess 31 (see FIG. 9). The recess 31 is configured to cover the bone conduction vibrator 202 exposed from the third accommodating groove 122. The recess 31 includes an in-ear side 32 facing the ear and a connecting side 33 facing the bone conduction vibrator 202. The in-ear side 32 is in contact with the ear. The connecting side 33 is in contact with the bone conduction vibrator 202 and the second housing portion 121.

In one of the possible implementations, a glue layer is provided at the join of the connecting side 33 and the second housing portion 121 to fix the connecting side 33 and the second housing portion 121. In addition, in other embodiments, a waterproof rubber pad may be provided at the join of the connecting side 33 and the second housing portion 121 to fix the connecting side 33 and the second housing portion 121 and provide a waterproof effect. Of course, in other embodiments, both the glue layer and the waterproof rubber pad may be provided. Firstly, the waterproof rubber pad is arranged between the connecting side 33 and the second housing portion 121, and then glue is used to fix the connecting side 33 and the second housing portion 121, thereby achieving fixing and waterproof effects.

In the embodiment of the present invention, one side of the earplug 30, facing the ear, is provided with a positioning protrusion 34. The positioning protrusion 34 protrudes obliquely outward from the outer peripheral side of the earplug 30.

Specifically, the positioning protrusion 34 includes a first protrusion 341 connected to the earplug 30 and a second protrusion 342 integrally connected to the first protrusion 341. The second protrusion 342 extends from the outer peripheral side of the first protrusion 341 along the extending direction of the first protrusion 341. The upper and lower ends of the first protrusion 341 are curved. The second protrusion 342 has an arc structure as a whole. One end of the first protrusion 341 integrally extends on the outer peripheral side of the earplug 30 and the peripheral area of the side of the earplug 30 facing the ear. One side of the first protrusion 341, facing the ear, is provided with a concave arc section (not shown). One end of the concave arc section extends into the side of the earplug 30 facing the ear. The other end of the concave arc section extends into one side of the second protrusion 342 facing the ear. When the ear hook 130 is worn, the first protrusion 341 and the second protrusion 342 extend toward the ear. The width of the positioning protrusion 34 gradually decreases from the first protrusion 341 to the second protrusion 342.

In the embodiment of the present invention, when in use, the bone conduction vibrator 202 extends to the ear along with the earplug 30. Another part of the bone conduction vibrator 202, exposed from one side of the second housing portion 121, is covered by the earplug 30. The earplug 30 is in contact with the bone conduction vibrator 202. The in-ear side 32 of the earplug 30 is in contact with the ossicles of the ear. The vibration of the bone conduction vibrator 202 is conducted through the earplug 30 to realize bone conduction sound. At this time, the positioning protrusion 34 is inserted into the ear along with the earplug 30. The first protrusion 341 and the second protrusion 342 extend outward. When inserted in the ear, the first protrusion 341 and the second protrusion 342 are plugged in the ear. The first protrusion 341 and the second protrusion 342 generate a force on the area in contact with the ear. Under the force, the first protrusion 341 and the second protrusion 342 are positioned in the ear. Besides, the first protrusion 341 and the second protrusion 342 of the positioning protrusion 34 are in contact with the ear, playing a role in transmitting vibration.

In one of the possible implementations, preferably, the positioning protrusion 34 is a protrusion made of silicone. The silicone protrusion is made of a soft material, making it more comfortable to wear and avoiding discomfort caused by the positioning protrusion to the wearer.

Figure 10:
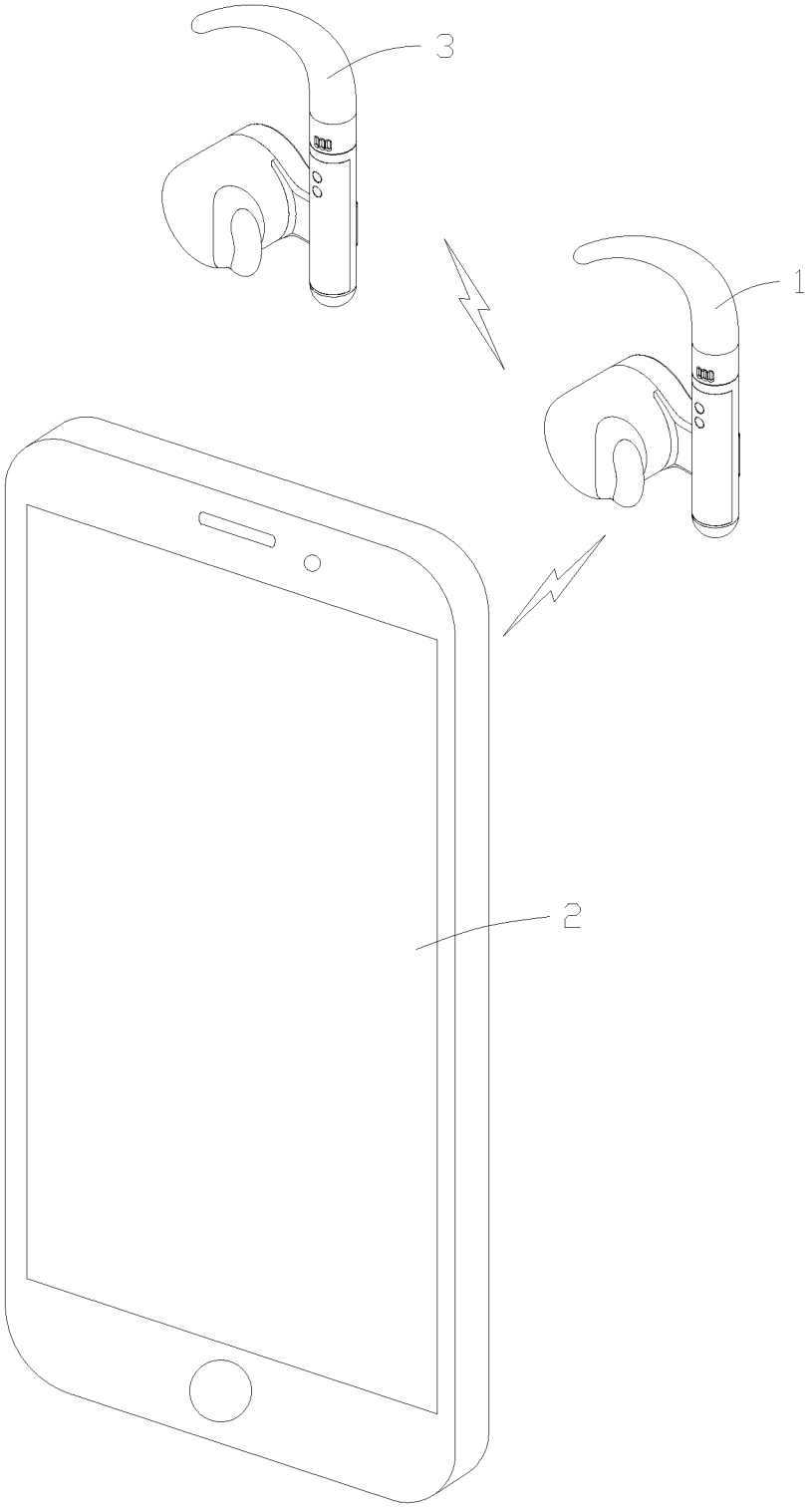
FIG. 10 is a schematic view of the TWS bone conduction earphone in communication with a Bluetooth device according to a preferred embodiment of the present invention.

Please refer to FIG. 10, which is a schematic view of the TWS bone conduction earphone 1 in communication with a first electronic device 2 and a second electronic device 3 according to a preferred embodiment of the present invention. The first electronic device 2 and the second electronic device 3 are electronic devices with Bluetooth function. In other embodiments, the first electronic device 2 and the second electronic device 3 may be mobile devices such as mobile phones, earphones, personal computers, tablet computers, personal digital assistants (PDAs), game consoles, interactive protocol televisions (IPTV), smart wearable devices and navigation devices, or electronic devices such as desktop computers and digital TVs.

The TWS bone conduction earphone 1 may be a master earphone and/or a slave earphone in a pair of TWS earphones. The structure and function of the master earphone and the slave earphone are the same. For example, the master earphone and the slave earphone each include an earphone housing 10, an earphone body 20, and an earplug 30, which will not be repeated hereinafter. A Bluetooth connection is established between the master earphone and the slave earphone. The master earphone and the slave earphone are used to convert sound signals received through the Bluetooth connection into mechanical vibrations of different frequencies.

In this embodiment, the TWS bone conduction earphone 1 is a main earphone in a pair of earphones, the first electronic device 2 is a mobile phone, and the second electronic device 3 is a slave earphone paired with the master earphone as an example. An application scenario is described below.

After getting the main earphone, the user touches the touch area 125 to wake up the main earphone. When the main earphone is turned on, the user touches the touch area 125 again, and the main earphone activates the Bluetooth module 209. The main earphone searches for nearby Bluetooth devices. The user turns on the Bluetooth of the mobile phone. The main earphone performs a Bluetooth pairing connection with the mobile phone through a pre-stored Bluetooth address. Correspondingly, the user can turn on the slave earphone by touching the touch area 125 on the earphone. When the user touches the touch area 125 on the slave earphone again, the slave earphone searches for the Bluetooth signal of the master earphone and then performs a Bluetooth connection with the master earphone.

In one of the possible implementations, the Bluetooth module of the slave earphone has been turned on for a long time. When the user touches the touch area 125 of the master earphone, the master earphone is turned on and the Bluetooth module 209 of the master earphone is activated, and then the master earphone and the slave earphone perform Bluetooth pairing, so that the master earphone controls the Bluetooth connection of the slave earphone. The master earphone, the slave earphone and the mobile phone are all paired and can perform Bluetooth communication. The Bluetooth module 209 of the main earphone receives the audio signal transmitted by the mobile phone and processes the received audio signal through the module on the circuit board 201 of the main earphone to obtain the corresponding audio signal. The power amplifier 213 amplifies the output audio signal and outputs the amplified signal to the bone conduction vibrator 202. The output audio signal is processed through the power amplifier 213 to increase the output power, amplify the sound signal, and improve the listening effect. The bone conduction vibrator 202 of the main earphone converts the audio signals into mechanical vibrations of different frequencies to be transmitted through the following conduction pathways: the skull, bony labyrinth, inner ear lymph, spiral organ, auditory nerve, and cerebral cortex (auditory center). Specifically, the mechanical vibrations are transmitted to the bony labyrinth through the user's skull, and the inner ear lymph generates vibration. The spiral organ completes the sensory process, and then the auditory nerve generates nerve impulses and transmits them to the auditory center. After comprehensive analysis of the cerebral cortex, the user can hear the sound. Correspondingly, the Bluetooth module 209 of the slave earphone receives the audio signal transmitted by the mobile phone to the master earphone from the Bluetooth module 209 of the master earphone. The Bluetooth module 209 of the slave earphone transmits the received audio signal to the circuit board 201 of the slave earphone to be processed by the module of the circuit board 201 of the slave earphone to obtain the corresponding audio signal. The bone conduction vibrator 202 of the main earphone performs vibration and sound transmission according to the audio signal. Its working principle is similar to that of the main earphone, and will not be repeated hereinafter.

In the embodiment of the present invention, through the combined design of the glue layer and the waterproof rubber pad, the overall waterproof performance of the earphone has been improved to ensure its normal use in sports such as running and swimming, thereby improving environmental applicability.

In summary, through the cooperation of TWS technology and bone conduction technology, the TWS bone conduction earphone of the present invention is not bound by a data cable and is more convenient to use. The bone conduction vibrator 202 vibrates the ossicles and transmits sound to the brain, avoiding damage to hearing caused by air conduction. The freedom of wearing is not restricted by the data cable, and the eardrum is protected, so that the user experience for users of TWS bone conduction earphone 1 is improved to enjoy wonderful music at any time.

Furthermore, by reasonably setting the gap between the bone conduction vibrator 202 and the battery 203, it is possible to ensure that the bone conduction vibrator 202 has an enough space, so that the swing amplitude of the bone conduction vibrator 202 is large, and all the overall space of the TWS bone conduction earphone 1 is small.

Furthermore, the ear hook 130 of the TWS bone conduction earphone of the present invention cooperates with the positioning protrusion 34 to achieve a stable wearing effect. The design of the ear hook 130 is exquisite and compact, which makes the earphone more beautiful, thereby improving the user experience. The earplug 30 cooperates with the ear hook, which further improves the wearing stability.

Furthermore, the first protrusion 341 and the second protrusion 342 of the positioning protrusion 34 on the earplug 30 enhance the positioning of the earphone. It solves the discomfort that the earphone sound is small and inaudible due to the looseness of the in-ear portion of the in-ear earphone, avoids the phenomenon that the earphone is easy to fall off, improves the user experience, and plays a role of transmitting vibration. When the earplug 30 is applied to the TWS bone conduction earphone 1, it can cooperate with the bone conduction vibrator 202 in the earphone to achieve a better effect of conducting vibration.

Secondly, the ear hook is detachably connected to the earphone, which realizes the detachable and replaceable setting of the ear hook, so that the earphone can be replaced with different ear hooks for different users.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A TWS (True Wireless Stereo) bone conduction earphone, comprising an earphone housing and an earphone body;

the earphone housing being configured to accommodate the earphone body;

the earphone body including a storage module, a Bluetooth module and a bone conduction module;

the storage module being configured to store a Bluetooth address corresponding to a Bluetooth device to be connected and paired;

the Bluetooth module being configured to establish a communication with the corresponding Bluetooth device according to the Bluetooth address to obtain an audio signal from the Bluetooth device, the bone conduction module vibrating according to the audio signal for transmitting sounds through ossicles;

wherein the earphone housing includes a first housing and a second housing;

the first housing and the second housing are engaged with each other to form a main receiving chamber for receiving the earphone body; and wherein the first housing includes a first connecting portion and a first housing portion;

the first housing portion is arranged at one side of the first connecting portion;

the second housing includes a second connecting portion and a second housing portion;

the second connecting portion is engaged with the first connecting portion to form a first receiving chamber;

the second housing portion is arranged at one side of the second connecting portion, a touch area is provided on an outer side wall of the second housing portion, so as to control the TWS bone conduction earphone by operating the touch area;

the second housing portion is engaged with the first housing portion to form a second receiving chamber, wherein the first receiving chamber and the second receiving chamber are configured to receive the earphone body.

2. The TWS bone conduction earphone as claimed in claim 1, wherein the earphone housing further includes an ear hook;

the ear hook is a curved ear hook to be located behind a pinna of a user's ear, the ear hook includes a first connecting end and a free end, the first connecting end is connected to the second connecting portion, the free end is opposite to the first connecting end, the free end is arc-shaped, when the user wears the TWS bone conduction earphone, the free end of the ear hook is located above a back side of the user's ear.

3. The TWS bone conduction earphone as claimed in claim 2, wherein the ear hook is detachably connected to the second connecting portion.

4. The TWS bone conduction earphone as claimed in claim 3, wherein the second connecting portion is provided with an engaging portion, the first connecting end of the ear hook is provided with a receiving cavity, and the engaging portion is detachably connected to the receiving cavity.

5. The TWS bone conduction earphone as claimed in claim 1, further comprising an ear hook, the ear hook being a head-mounted ear hook; the TWS bone conduction earphone including two TWS bone conduction earphones, two ends of the head-mounted ear hook being connected to the earphone housings of the two TWS bone conduction earphones, respectively.

6. The TWS bone conduction earphone as claimed in claim 1, wherein the bone conduction module includes a power amplifier and a bone conduction vibrator;

the power amplifier is electrically connected to the bone conduction vibrator and the Bluetooth module, and is configured to process and transmit the audio signal received by the Bluetooth module to the bone conduction vibrator;

the bone conduction vibrator is configured to vibrate the ossicles according to the processed audio signal to transmit sounds;

the power amplifier is arranged in the first receiving chamber;

the bone conduction vibrator is arranged in the second receiving chamber.

7. The TWS bone conduction earphone as claimed in claim 6, wherein the earphone body further includes a charging and discharging module and a battery;

the charging and discharging module is electrically connected to the battery for controlling charging and discharging of the battery;

the battery is configured to supply power to the TWS bone conduction earphone;

the charging and discharging module is arranged in the first receiving chamber;

the battery is arranged in the second receiving chamber.

8. The TWS bone conduction earphone as claimed in claim 7, wherein two sides of the first housing portion are formed with a first accommodating groove and a second accommodating groove respectively, the first accommodating groove communicates with the second accommodating groove, the first accommodating groove is configured to accommodate the bone conduction vibrator, and the second accommodating groove is configured to accommodate the battery.

9. The TWS bone conduction earphone as claimed in claim 8, wherein a gap between the bone conduction vibrator and the battery is 0.2 mm to 3 mm.

10. The TWS bone conduction earphone as claimed in claim 6, further comprising an earplug made of silicone;

the earplug being arranged on one side of the earphone housing and covering the bone conduction vibrator;

one side of the earplug, facing the ear, being provided with a positioning protrusion, the positioning protrusion protruding obliquely outward from an outer peripheral side of the earplug.

11. The TWS bone conduction earphone as claimed in claim 8, wherein a part of the bone conduction vibrator is arranged in the first accommodating groove, another part of the bone conduction vibrator is exposed from the first accommodating groove;

the earplug covers the another part of the bone conduction vibrator exposed from the first accommodating groove.

* * * * *